US012064031B2

(12) United States Patent
Choi

(10) Patent No.: US 12,064,031 B2
(45) Date of Patent: Aug. 20, 2024

(54) TABLE WITH MINIMIZED THICKNESS WHEN FOLDED

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 179 days.

(21) Appl. No.: 17/590,375

(22) Filed: Feb. 1, 2022

(65) Prior Publication Data

US 2022/0330691 A1 Oct. 20, 2022

(30) Foreign Application Priority Data

Apr. 20, 2021 (CN) ..... 202120807218.3

(51) Int. Cl.

| | |
|---|---|
| ***A47B 3/00*** | (2006.01) |
| ***A47B 3/083*** | (2006.01) |
| ***A47B 3/091*** | (2006.01) |
| ***A47B 13/00*** | (2006.01) |

(52) U.S. Cl.

CPC ..... *A47B 3/0915* (2013.01); *A47B 3/083* (2013.01); *A47B 13/003* (2013.01)

(58) Field of Classification Search

CPC ..... A47B 3/0915; A47B 3/083; A47B 3/087; A47B 13/003; A47B 13/08; A47B 13/10; A47B 13/088; A47B 2200/001; A47B 2003/0835

USPC ..... 108/160, 161, 901, 166–169, 174

See application file for complete search history.

(56) References Cited

U.S. PATENT DOCUMENTS

| | | | |
|---|---|---|---|
| 893,364 | A | 7/1908 | Piaser |
| 1,063,642 | A | 6/1913 | Birdsell |
| 1,196,253 | A | 8/1916 | Lovvy |
| 1,599,971 | A | 9/1926 | Melson |
| 2,136,569 | A | 11/1938 | Trimpi |
| 2,572,333 | A | 10/1951 | Greitzer |
| 2,803,033 | A | 8/1957 | Rachman |
| 2,803,050 | A | 8/1957 | Fernberg |

(Continued)

FOREIGN PATENT DOCUMENTS

| | | |
|---|---|---|
| CA | 2971886 | 12/2018 |
| CN | 201767333 U | 3/2011 |

(Continued)

OTHER PUBLICATIONS

CN206092607 English trasnlation (Year: 2017).*

*Primary Examiner* — Janet M Wilkens
(74) *Attorney, Agent, or Firm* — MORGAN, LEWIS & BOCKIUS LLP

(57) ABSTRACT

A foldable table includes first and second panels, first and second mounting assemblies coupled respectively with the first and second panels, and first and second leg assemblies coupled respective with the first and second mounting assemblies. Each of the first and second panels is formed with upper and lower panel surfaces spaced apart at a first distance. Each of the first and second panels is also formed with a ridge or protrusions or both of the ridge and protrusions. A lower surface of the ridge is spaced apart from the upper panel surface at a second distance equal to or less than two times the first distance. A lower surface of each protrusion is spaced apart from the upper panel surface at a third distance equal to or less than 1.5 times the first distance. Thus, when folded, the table has a minimized thickness.

12 Claims, 13 Drawing Sheets

(56) References Cited

U.S. PATENT DOCUMENTS 2,868,599 A 1/1959 Roggio
3,027,209 A 3/1962 Nielsen
3,075,809 A 1/1963 Wilson
3,187,373 A 6/1965 Fisher
3,188,138 A 6/1965 Lockshin
3,368,504 A 2/1968 Cohen
3,410,232 A 11/1968 Bills
3,410,327 A 11/1968 Ausnit
3,750,598 A 8/1973 Campbell
3,861,328 A 1/1975 Lawless
4,191,111 A 3/1980 Emmert
4,244,471 A 1/1981 Plante
4,285,105 A 8/1981 Kirkpatrick
4,561,108 A 12/1985 Kamp
4,597,553 A 7/1986 Rorabaugh
4,773,108 A 9/1988 Leever
4,792,240 A 12/1988 Ausnit
5,180,064 A 1/1993 Elvin-Jensen
5,226,372 A 7/1993 Frenkel
5,325,794 A 7/1994 Hontani
5,331,725 A 7/1994 Chou
5,483,710 A 1/1996 Chan
5,745,954 A 5/1998 Shogan
5,857,229 A 1/1999 Magnani, Jr.
6,062,589 A 5/2000 Cheng
6,223,366 B1 5/2001 Cheng
6,223,628 B1 5/2001 Barron
6,354,230 B1 3/2002 Maschio
6,363,550 B1 4/2002 Wang
6,386,118 B1 5/2002 Bendit
6,508,262 B1 1/2003 Takayama
6,575,656 B2 6/2003 Suh
6,823,806 B1 * 11/2004 Buono ..... A47B 3/0912 108/132
6,843,183 B2 1/2005 Strong
6,938,927 B1 9/2005 Martin
6,971,321 B1 12/2005 Strong
7,059,254 B2 6/2006 Strong et al.
7,066,676 B2 6/2006 Tsai
7,096,799 B2 8/2006 Strong et al.
7,097,380 B2 8/2006 Lee
7,144,078 B2 12/2006 Hsieh
7,171,910 B2 2/2007 Neunzert et al.
7,260,871 B2 8/2007 Borchardt
7,428,872 B2 9/2008 Strong et al.
7,475,643 B2 1/2009 Haney et al.
7,475,644 B2 1/2009 Strong et al.
7,634,969 B2 12/2009 Neunzert et al.
7,640,870 B2 1/2010 Strong et al.
7,644,667 B2 1/2010 Strong et al.
7,735,431 B2 6/2010 Neunzert et al.
7,849,867 B2 12/2010 Takayama
7,874,303 B2 1/2011 Xie
7,926,431 B2 4/2011 Morris
8,006,630 B2 8/2011 Strong et al.
8,033,228 B2 10/2011 Haney et al.
8,042,475 B2 10/2011 Larcom et al.
8,113,130 B2 2/2012 Leng
8,156,875 B2 4/2012 Neunzert et al.
8,302,541 B2 11/2012 Haney et al.
8,336,466 B2 12/2012 Mani
8,342,107 B2 1/2013 Mover et al.
8,534,205 B1 9/2013 Johnson et al.
8,578,865 B2 11/2013 Haney et al.
8,622,007 B2 1/2014 Peery et al.
8,707,478 B2 4/2014 Jin
8,746,155 B2 6/2014 Haney et al.
8,757,069 B2 6/2014 Peery et al.
8,806,677 B1 8/2014 Bartelsmeyer
8,856,984 B1 10/2014 Donham
8,888,123 B1 11/2014 Cheng
8,904,943 B2 12/2014 Jin
9,027,952 B2 5/2015 Zhu
9,103,368 B2 8/2015 Mendes
9,107,509 B2 8/2015 Lee
D748,418 S 2/2016 Johnson et al.
9,248,072 B2 2/2016 Wu
9,254,046 B1 2/2016 Arenstein
9,277,808 B2 3/2016 Cai et al.
9,282,812 B2 3/2016 Chang
9,314,386 B1 4/2016 Boyd
D756,694 S 5/2016 Johnson et al.
9,351,563 B2 5/2016 Bennett et al.
9,456,698 B2 10/2016 Oh
9,532,645 B1 1/2017 Lin
9,907,405 B2 3/2018 An
10,021,986 B1 7/2018 Lin
10,123,629 B2 11/2018 Choi
10,125,801 B2 11/2018 Wilson
10,285,506 B2 5/2019 Choi
10,405,645 B1 * 9/2019 Liu ..... A47B 3/0818
10,470,561 B2 11/2019 Clegg et al.
10,806,246 B1 10/2020 Chen
10,932,560 B2 3/2021 Leng
11,147,377 B2 * 10/2021 Lin ..... B29C 49/02
11,286,083 B2 3/2022 Lee
11,564,492 B2 1/2023 Choi
11,564,494 B2 1/2023 Choi
2003/0009848 A1 1/2003 Kuo
2003/0089286 A1 5/2003 Wang
2003/0233967 A1 12/2003 Lin
2005/0005826 A1 1/2005 Strong
2005/0011422 A1 1/2005 Wen
2005/0097829 A1 5/2005 Seo
2005/0160950 A1 7/2005 Haney
2005/0193927 A1 9/2005 Herring
2005/0241550 A1 11/2005 Neunzert
2005/0241552 A1 * 11/2005 Neunzert ..... A63B 63/083 108/159
2005/0274304 A1 12/2005 Strong
2005/0279260 A1 12/2005 Stanford
2006/0062632 A1 3/2006 Jang
2006/0196395 A1 9/2006 Lin
2006/0236902 A1 10/2006 Haney
2007/0012346 A1 1/2007 Choi
2007/0079441 A1 4/2007 Chen
2007/0199483 A1 8/2007 Peery
2008/0078310 A1 4/2008 VanNimwegen
2009/0114129 A1 5/2009 Smith
2009/0133191 A1 5/2009 Harrow
2009/0255564 A1 10/2009 Xie
2010/0043676 A1 2/2010 Apps
2010/0176634 A1 7/2010 Wahl
2010/0192813 A1 8/2010 Fry
2010/0251941 A1 10/2010 Muirhead
2010/0299831 A1 12/2010 Lee
2011/0099712 A1 5/2011 Jin
2012/0107037 A1 5/2012 Huang
2012/0141195 A1 6/2012 Lu
2012/0222216 A1 9/2012 Jin
2012/0266791 A1 10/2012 Peery
2013/0000528 A1 1/2013 Jin
2013/0025509 A1 1/2013 Jin
2013/0067659 A1 3/2013 Oh
2013/0133557 A1 5/2013 Yoshinaga
2013/0233210 A1 9/2013 Jin
2013/0276228 A1 10/2013 Hsieh
2014/0030012 A1 1/2014 Lee
2014/0070070 A1 3/2014 Shinoda
2014/0099155 A1 4/2014 Chen
2014/0130837 A1 5/2014 Sy-Facunda
2015/0130250 A1 5/2015 Masunaga
2015/0143630 A1 5/2015 Harrow
2015/0320225 A1 11/2015 Boyd
2015/0327684 A1 11/2015 Lee
2016/0157620 A1 6/2016 Oh
2016/0227919 A1 * 8/2016 Turner ..... A47B 3/083
2016/0348395 A1 12/2016 Jin
2017/0013955 A1 1/2017 Lin
2017/0122353 A1 5/2017 Halliburton
2017/0238698 A1 * 8/2017 Nye ..... E04C 2/326
2018/0153302 A1 6/2018 Jiang
2018/0192768 A1 7/2018 Choi
2019/0150608 A1 5/2019 Johnson et al.

(56) References Cited

U.S. PATENT DOCUMENTS

| | | | |
|---|---|---|---|
| 2019/0200753 | A1 | 7/2019 | Choi |
| 2019/0283304 | A1 | 9/2019 | Lin |
| 2019/0284831 | A1 | 9/2019 | Volin |
| 2019/0292808 | A1 | 9/2019 | Dotterweich |
| 2020/0029684 | A1 | 1/2020 | Jiang |
| 2020/0231333 | A1 | 7/2020 | Holm |
| 2021/0031831 | A1 | 2/2021 | Yoshizaki |
| 2021/0147111 | A1 | 5/2021 | Lopez Uran |
| 2021/0345776 | A1 | 11/2021 | Choi |
| 2021/0354876 | A1 | 11/2021 | Turner |
| 2022/0288835 | A1 | 9/2022 | Jiang |

FOREIGN PATENT DOCUMENTS

| | | | | |
|---|---|---|---|---|
| CN | 204336376 | U | | 5/2015 |
| CN | 204336377 | U | | 5/2015 |
| CN | 206092607 | | * | 4/2017 |
| CN | 209185860 | U | | 8/2019 |
| CN | 213464190 | U | | 6/2021 |
| DE | 29515948 | | | 1/1996 |
| EP | 1492432 | B1 | | 10/2016 |
| EP | 2701552 | B1 | | 7/2018 |
| GB | 810195 | A | | 3/1959 |
| WO | WO 2013000149 | A1 | | 1/2013 |

* cited by examiner

TABLE WITH MINIMIZED THICKNESS WHEN FOLDED

CROSS-REFERENCE TO RELATED APPLICATIONS

The present application claims priority to Chinese Utility Model Application CN 202120807218.3 filed Apr. 20, 2021. The disclosure of the application is incorporated herein for all purposes by reference in its entirety.

FIELD OF THE INVENTION

The present invention generally relates to tables and, in particular, to foldable tables with minimized thicknesses when folded.

BACKGROUND

Foldable tables are more and more popular these days. A typical foldable table usually includes a table panel and a foldable frame for supporting the table panel. However, many existing foldable tables are heavy and when folded, are thick and large. As such, they are inconvenient to transport or carry around.

Given the current state of the art, there remains a need for tables that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides foldable tables that are lighter, thinner when folded, and more stable in use.

In various exemplary embodiments, the present disclosure provides a foldable table including first and second panels, first and second mounting assemblies, and first and second leg assemblies. Each respective panel in the first and second panels includes an upper panel surface and a lower panel surface spaced apart from the upper panel surface at a first distance. Each respective panel also includes a ridge monolithically formed with the respective panel at or adjacent to an edge of the respective panel. The ridge extends downward beyond the lower panel surface and includes a lower ridge surface spaced apart from the upper panel surface at a second distance. The second distance is equal to or less than two times the first distance. The first and second mounting assemblies are pivotally coupled with each other at proximal sides of the first and second mounting assemblies, with the first mounting assembly disposed below the lower panel surface of the first panel and coupled with the first panel and the second mounting assembly disposed below the lower panel surface of the second panel and coupled with the second panel. The first leg assembly is pivotally coupled with the first mounting assembly at a distal side of the first mounting assembly, and the second leg assembly is pivotally coupled with the second mounting assembly at a distal side of the second mounting assembly.

In an exemplary embodiment, the lower panel surface is substantially parallel to the upper panel surface.

In some exemplary embodiments, each respective panel further includes a plurality of protrusions monolithically formed with the respective panel across at least a portion of the respective panel to enhance a strength of the respective panel. Each of the plurality of protrusions protrudes downward from the lower panel surface and includes a lower protrusion surface spaced apart from the upper panel surface at a third distance.

In an exemplary embodiment, the third distance is equal to or less than 1.5 times the first distance.

In some exemplary embodiments, the lower protrusion surface of a protrusion in the plurality of protrusions is substantially flat, arched, or dome-shaped.

In an exemplary embodiment, the plurality of protrusions is formed across at least a majority portion of the respective panel.

In an exemplary embodiment, protrusions in at least a subset of the plurality of protrusions are arranged substantially uniformly across the portion of the respective panel.

In some exemplary embodiments, each respective panel further includes a plurality of depressions monolithically formed with the respective panel, each recessing from the lower panel surface toward the upper panel surface.

In an exemplary embodiment, depressions in at least a subset of the plurality of depressions are arranged alternately with protrusions in at least a subset of the plurality of protrusions across the at least a portion of the respective panel. The plurality of depressions and the plurality of protrusions collectively enhance the strength of the respective panel.

In some exemplary embodiments, each respective panel further includes a plurality of ribs monolithically formed with the respective panel, each protruding downward from the lower panel surface of the respective panel. Each respective rib in at least a subset of the plurality of ribs connects corresponding adjacent protrusions in the plurality of protrusions.

In an exemplary embodiment, each of the plurality of ribs includes a lower rib surface or rim spaced apart from the upper panel surface at a fourth distance that is substantially the same as the third distance.

In some exemplary embodiments, the foldable table further includes first and second supporting assembly. The first supporting assembly is coupled with the first leg assembly and first mounting assembly and configured to control rotation of the first leg assembly with respect to the first mounting assembly. The second supporting assembly is coupled with the second leg assembly and second mounting assembly and configured to control rotation of the second leg assembly with respect to the second mounting assembly.

In various exemplary embodiments, the present disclosure provides a foldable table including first and second panels, first and second mounting assemblies, and first and second leg assemblies. Each respective panel in the first and second panels includes an upper panel surface and a lower panel surface spaced apart from the upper panel surface at a first distance. Each respective panel also includes a plurality of protrusions monolithically formed with the respective panel across at least a portion of the respective panel. Each of the plurality of protrusions protrudes downward from the lower panel surface and includes a lower protrusion surface spaced apart from the upper panel surface at a third distance. The third distance is equal to or less than 1.5 times the first distance. The first and second mounting assemblies are pivotally coupled with each other at proximal sides of the first and second mounting assemblies, with the first mounting assembly disposed below the lower panel surface of the first panel and coupled with the first panel, and the second mounting assembly disposed below the lower panel surface of the second panel and coupled with the second panel. The first leg assembly is pivotally coupled with the first mounting assembly at a distal side of the first mounting assembly, and the second leg assembly is pivotally coupled with the second mounting assembly at a distal side of the second mounting assembly.

In some exemplary embodiments, the lower protrusion surface of a protrusion in the plurality of protrusions is substantially flat, arched, or dome-shaped.

In some exemplary embodiments, the plurality of protrusions is formed across at least a majority portion of the respective panel.

In an exemplary embodiment, protrusions in at least a subset of the plurality of protrusions are arranged substantially uniformly across the portion of the respective panel.

In some exemplary embodiments, each respective panel further includes a plurality of depressions monolithically formed with the respective panel, each recessing from the lower panel surface toward the upper panel surface.

In an exemplary embodiment, depressions in at least a subset of the plurality of depressions are arranged alternately with protrusions in at least a subset of the plurality of protrusions across the at least a portion of the respective panel. The plurality of depressions and the plurality of protrusions collectively enhance the strength of the respective panel.

In some exemplary embodiments, each respective panel further includes a plurality of ribs monolithically formed with the respective panel, each protruding downward from the lower panel surface of the respective panel. Each respective rib in at least a subset of the plurality of ribs connects corresponding adjacent protrusions in the plurality of protrusions.

In an exemplary embodiment, each of the plurality of ribs includes a lower rib surface or rim spaced apart from the upper panel surface at a fourth distance that is substantially the same as the third distance.

The tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
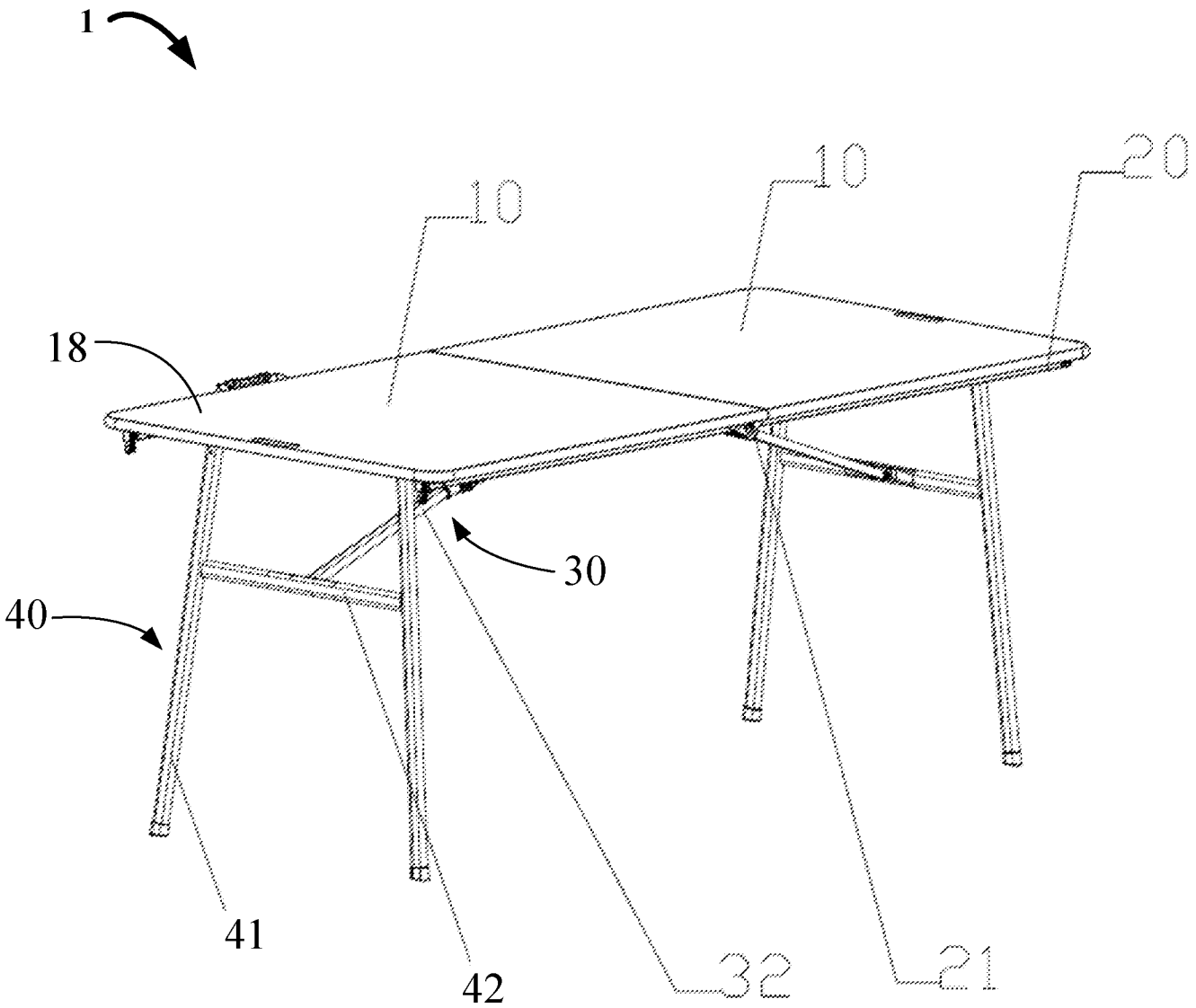
FIG. 1 is a perspective view schematically illustrating an exemplary foldable table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable tables. A foldable table of the present disclosure generally includes a first panel, a second panel, a first mounting frame coupled with the first panel and a second mounting frame coupled with the second panel. The first and second mounting assemblies are pivotally coupled with each other at their proximal sides so that the table can be folded in half. The panels and/or other components of the table are configured and sized to reduce the weight of the table, enhance the strength of the table, and/or minimize the thickness of the table when it is folded. As such, the foldable tables of the present disclosure are stable when in use, require less storage space and are easy to carry around.

Referring now to FIGS. 1-4, there is depicted an exemplary foldable table 1 in accordance with some exemplary embodiments of the present disclosure. Table 1 includes a first panel, a second panel, a first mounting assembly, a second mounting assembly, a first leg assembly and a second leg assembly. The first and second panels can be but do not necessarily have to be identical or symmetric with respect to each other. Similarly, the first and second mounting assemblies can be but do not necessarily have to be identical or symmetric with respect to each other. The first and second leg assemblies can be but do not necessarily have to be identical or symmetric with respect to each other. By way of example, FIGS. 1-4 illustrate the first and second panels (e.g., panels 10) being substantially the same and disposed symmetrically with respect to each other, the first and second mounting assemblies (e.g., mounting assemblies 20) being substantially the same and disposed symmetrically with respect to each other, and the first and second leg assemblies (e.g., leg assemblies 30) being substantially the same and disposed symmetrically with respect to each other.

The first mounting assembly is disposed under the first panel and coupled with the first panel. The second mounting assembly is disposed under the second panel and coupled with the second panel. Moreover, the first and second mounting assemblies are pivotally coupled with each other at their proximal sides, for instance, by one or more couplers such as coupler 21. As used herein, the sides at which first and second mounting assemblies are connected to each other are referred to as their proximal sides, and the sides opposite the proximal sides are referred to as their distal sides. For instance, in FIG. 4, the proximal sides of first and second mounting assemblies are in the middle of the foldable frame. The distal sides correspond to the upper and lower sides of the figure. It should be noted that the term "middle" as used herein does not necessarily mean the center of the frame, and the term "side" does not necessarily mean an outmost edge of the frame.

The first leg assembly is pivotally coupled with the first mounting assembly at a distal side of the first mounting assembly, and thus is rotatable with respect to the first mounting assembly between a use position and a storage position. Similarly, the second leg assembly is pivotally coupled with the second mounting assembly at a distal side of the second mounting assembly, and thus is rotatable with respect to the second mounting assembly between a use position and a storage position.

Figure 2:
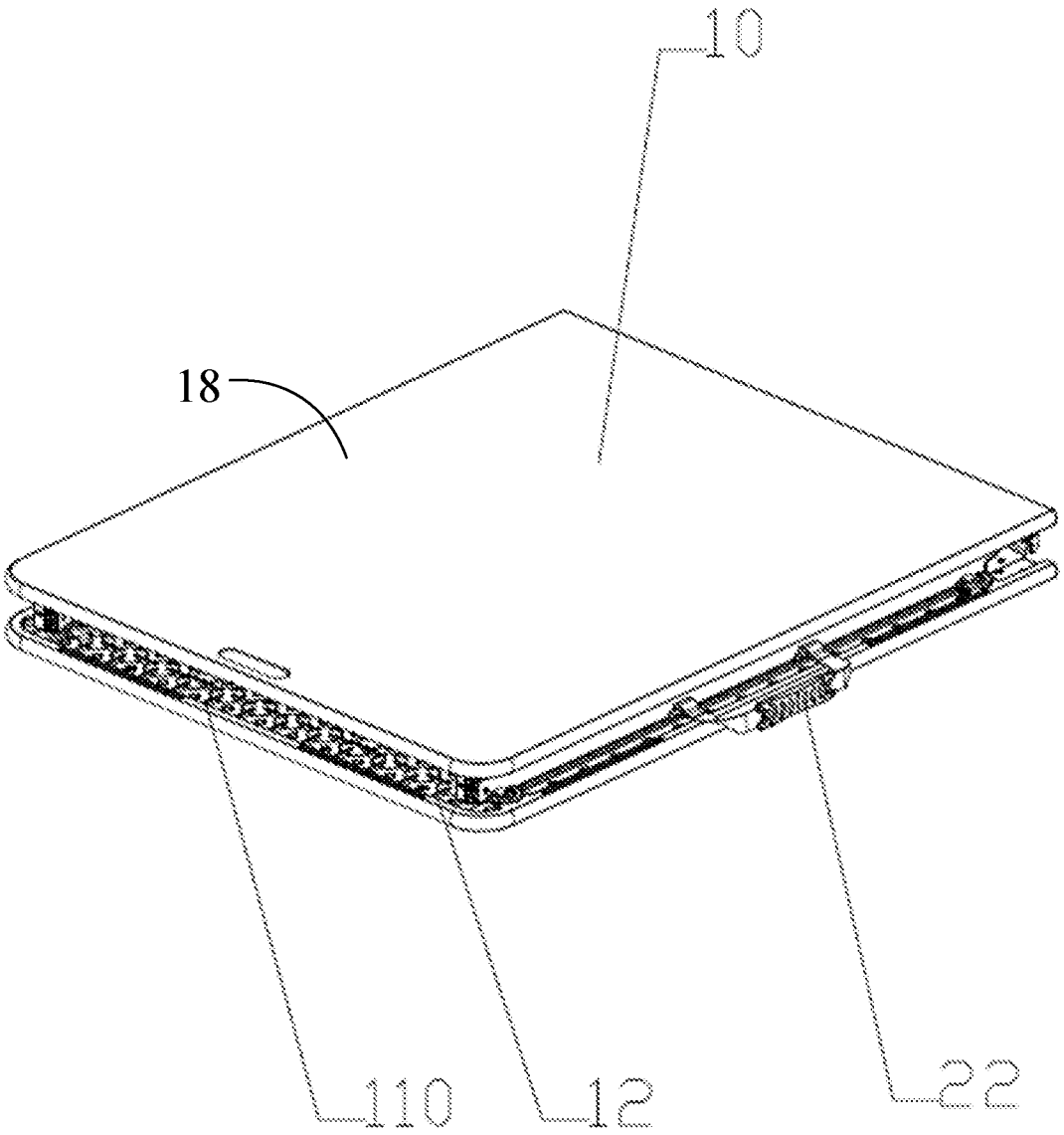
FIG. 2 is a perspective view schematically illustrating the foldable table of FIG. 1 in a folded state in accordance with exemplary embodiments of the present disclosure.

Since the first and second mounting assemblies are pivotally coupled with each other at their proximal sides, for instance, by one or more couplers such as coupler 21, the first and second mounting assemblies can be folded onto each other. As such, the table can be folded in half as illustrated in FIG. 2, with the mounting and leg assemblies disposed between the first and second panels.

In some exemplary embodiments, at least one coupler 21 includes a locking mechanism. When the table is unfolded and in use, the locking mechanism locks and retains the first and second mounting assemblies in the unfolded positions with respect to each other. Examples of locking mechanisms are disclosed in U.S. patent application Ser. No. 16/838,939 (now U.S. Pat. No. 10,863,819 B1), U.S. patent application Ser. No. 16/839,337 (now U.S. Pat. No. 10,806,246 B2) and U.S. patent application Ser. No. 17/368,284, the disclosure of each application is incorporated herein for all purposes by reference in its entirety. The locking mechanism prevents accidental folding of the table and thus makes the table safer and more reliable when in use.

In some exemplary embodiments, to enhance the stability of the table, table 1 includes one or more supporting assemblies, each configured to control rotation of a leg assembly, to stabilize a leg assembly when unfolded, or to help support one or more mounting assemblies. For instance, in some exemplary embodiments, table 1 includes first and second supporting assemblies, which can be configured the same as or differently from each other. By way of example, FIGS. 1-4 illustrate the first and second supporting assemblies, e.g., supporting assemblies 30, being substantially the same as each other. The first supporting assembly is coupled with the first leg assembly and the first mounting assembly. The second supporting assembly is coupled with the second leg assembly and the second mounting assembly.

For instance, in some embodiments, leg assembly 40 includes one or more legs, such as leg 41, and an intermediate member, such as intermediate member 42, coupled with a middle portion of the one or more legs. Supporting assembly 30 includes a first supporting member such as first supporting member 32, a controller such as controller 34, and one or more second supporting members such as second supporting member 33. First supporting member 32 is coupled with intermediate supporting member 42. In an embodiment, first supporting member 32 is fixedly coupled with intermediate member 42. In another embodiment, first supporting member 32 is pivotally coupled with intermediate member 42. Controller 34 is coupled with first supporting member 32 and selectively movable along the first supporting member. In an exemplary embodiment, controller 34 is configured to be a slider or to include a slider similar to those disclosed in U.S. patent application Ser. Nos. 16/838,939, 16/838,944 and 16/838,947, the disclosure of each application is incorporated herein for all purposes by reference in its entirety. Second supporting member 33 has a first end portion pivotally coupled with the controller and a second end portion pivotally coupled with the first or second mounting assembly.

In some exemplary embodiments, the supporting assembly is the same as or similar to those disclosed in U.S. patent application Ser. No. 16/951,461 and U.S. patent application Ser. No. 17/368,284, the disclosure of each application is incorporated herein for all purposes by reference in its entirety.

The supporting assembly allows the leg assembly to rotate between a use position (e.g., when the leg assembly supports the mounting assembly and panel as illustrated in FIG. 1) and a storage position (e.g., when the leg assembly folds to the mounting assembly and panel). When the leg assembly is in the use position, the controller is restricted from moving along the first supporting member (e.g., by a pin or the like), thereby preventing accidental folding of the leg assembly and consequently stabilizing the table.

Referring to FIGS. 1-2 and 4-7, in some exemplary embodiments, panel 10 includes an upper panel surface, such as upper panel surface 18, and a lower panel surface, such as lower panel surface 11. The upper panel surface serves as the working surface when the table is in use and is the outmost surface when the table is folded. The lower panel surface is generally spaced apart from the upper panel surface at a first distance, e.g., first distance "Lb".

Panel 10 can be of various sizes and of various shapes including but not limited to rectangles and squares. It can be made of any suitable material, for instance, by blow molding plastics such as high density polyethylene (HDPE), low density polyethylene (LDPE), polypropylene (PP), polyvinyl chloride (PVC), polyethylene terephthalate (PET), thermoplastic elastomers (TPE), or the like.

In some exemplary embodiments, panel 10 is made by blow-molding of a plastic or the like, creating a generally hollow interior between the upper and lower panel surfaces. However, it should be noted that the upper and lower panel surfaces (or panel walls) can be but do not have to be completely spaced apart from each other. For instance, in some exemplary embodiments, the upper and lower panel surfaces (or panel walls) can be joined with each other at one or more locations. Similarly, the generally hollow interior can be completely hollow or partially hollow with one or more structures formed or disposed within. The generally hollow structure reduces the weight of the panel.

The upper and lower panel surfaces each can be planar or nonplanar. For instance, in an exemplary embodiment, each of the upper and lower panel surfaces is substantially planar, and the upper and lower panel surfaces are substantially parallel to each other. In another exemplary embodiment, at least a portion of the upper or lower panel surface is curved.

In some exemplary embodiments, panel 10 also includes a ridge (or lip), such as ridge 12. The ridge can be formed at any suitable position. For instance, the ridge can be formed at or adjacent to an edge of the panel, at or adjacent to the entire perimeter of the panel, or at a position away from an edge of the panel. The ridge can also be straight or curved or composed of straight and curved segments. For instance, in an exemplary embodiment, at least a portion of the ridge is straight, e.g., a ridge formed at an edge of a rectangular or square panel. In another exemplary embodiment, at least a portion of the ridge is curved, e.g., a ridge formed along a portion of the perimeter of a circular or oblong panel. The height of the ridge, which represents a dimension of the ridge along a vertical direction of the table when the table is in use or a dimension of the ridge along a thickness of the table when the table is folded, is limited within a certain range to minimize the thickness of the table when it is folded.

For instance, in some exemplary embodiments, the ridge extends downward beyond the lower panel surface and includes a lower ridge surface, such as lower ridge surface 121. The lower ridge surface is generally spaced apart from the upper panel surface at a second distance, e.g., second distance "La". Like the upper and lower surfaces of the panel, the lower ridge surface can be planar or non-planar, and can include other additional or optional features such as indentations, depressions, protrusions or the like. Second distance "La" is equal to or less than 2× first distance "Lb". In some exemplary embodiments, second distance "La" is equal to or less than 1.9×, 1.8×, 1.7× or 1.6× first distance "Lb". The second distance is set so that the ridge not only enhances the strength of the panel, but also serves as a structure for coupling with the mounting assembly. The use of the ridge also allows to minimize the thickness of the table when folded and reduce the total weight of the table.

Referring to FIGS. 4-9, in some exemplary embodiments, panel 10 includes one or more different types of strengthening elements to enhance the strength (e.g., rigidity) of the panel and prevent the panel from bending, warping or deforming. The strengthening elements allows construction of panels with thinner walls, and result in lighter and thinner panels.

For instance, in some exemplary embodiments, panel 10 includes protrusions 13, ribs 14, and/or depressions 111. It should be noted that this is a non-limiting example and strengthening elements are combinable in any useful numbers and manners. For instance, panel 10 can include but do not have to include all three different types of strengthening elements. Panel 10 can also include other additional, optional, or alternative strengthening elements such as channels, trenches or the like. Examples of strengthening elements are disclosed in U.S. patent application Ser. Nos. 17/172,990, 17/193,421, and 17/368,469, the disclosure of each application is incorporated herein for all purposes by reference in its entirety.

Moreover, strengthening elements (e.g., depressions, protrusions, or ribs) can have any suitable shapes, sizes or orientations. For instance, a depression can have a regular (e.g., rectangular, square, circular, oblong or the like) or irregular shape. In addition, adjacent depressions can have the same configuration or different configurations. Similarly, a protrusion/rib can have a regular or irregular shape, and adjacent protrusions/ribs can have the same configuration or different configurations Further, depressions, protrusions, ribs, and/or other strengthening elements can be formed at any suitable positions independent from each other or related to each other. For instance, a protrusion can be formed at a position adjacent to none of the plurality of depressions, or at a position adjacent to 1, 2 or more than 2 depressions. Likewise, a depression can be formed at a position adjacent to none of the plurality of protrusions, or at a position adjacent to 1, 2 or more than 2 protrusions. The depressions, protrusions, ribs, and/or strengthening elements can be arranged uniformly or nonuniformly across the panel.

Figure 4:
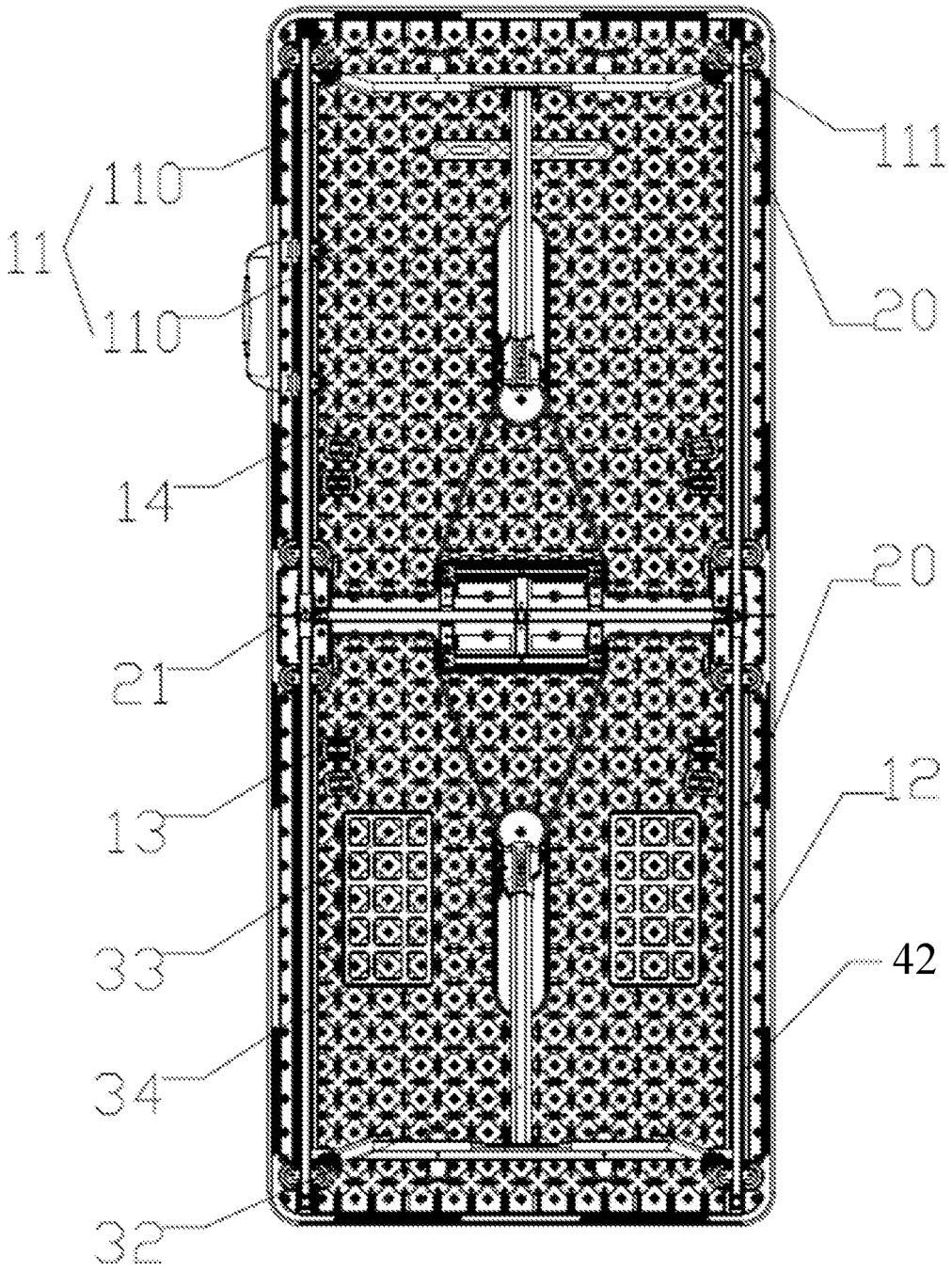
FIG. 4 is a bottom view schematically illustrating the foldable table of FIG. 1.
Figure 5A:
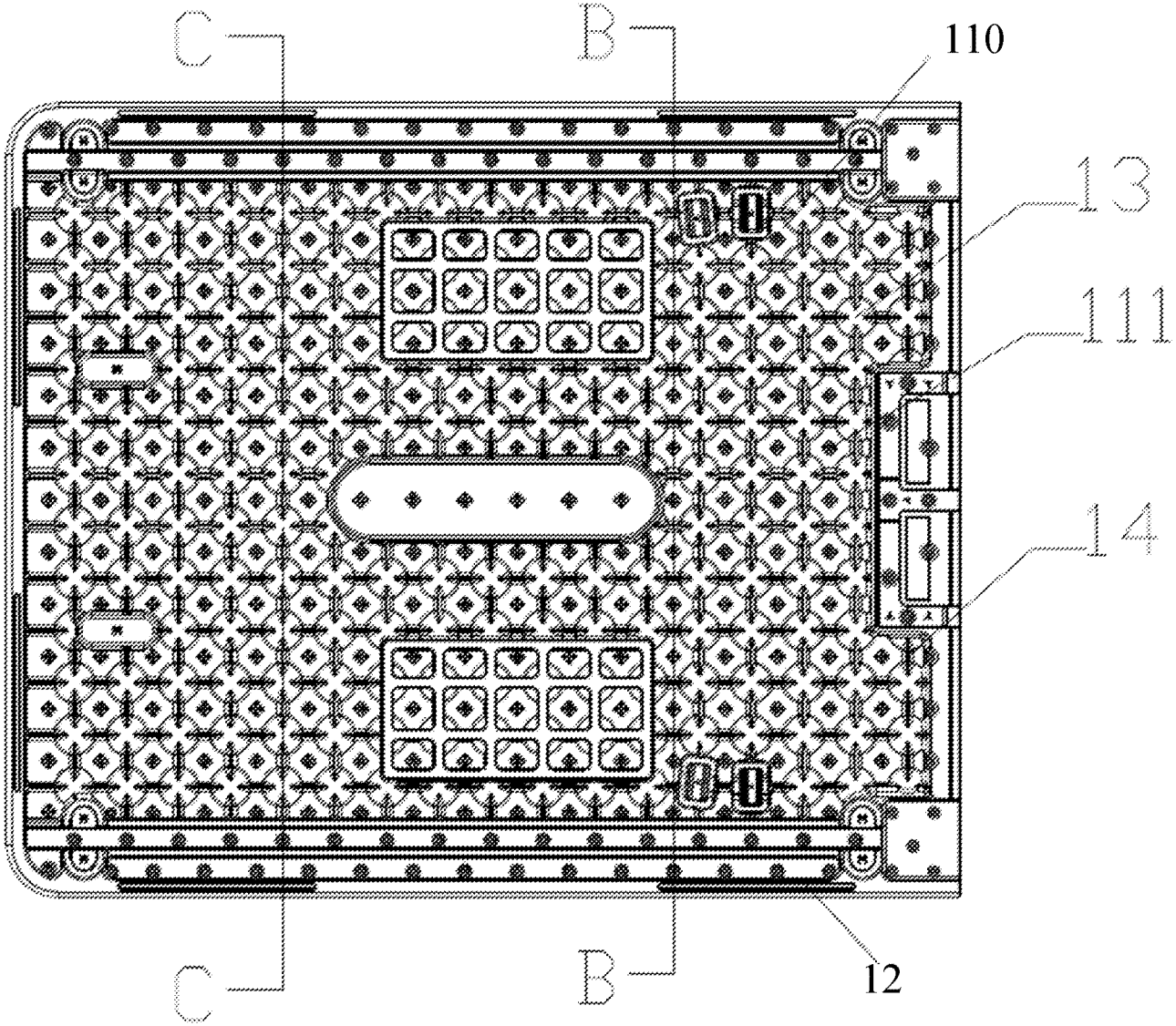
FIG. 5A is a bottom view schematically illustrating an exemplary panel of the foldable table of FIG. 1.
Figure 5B:
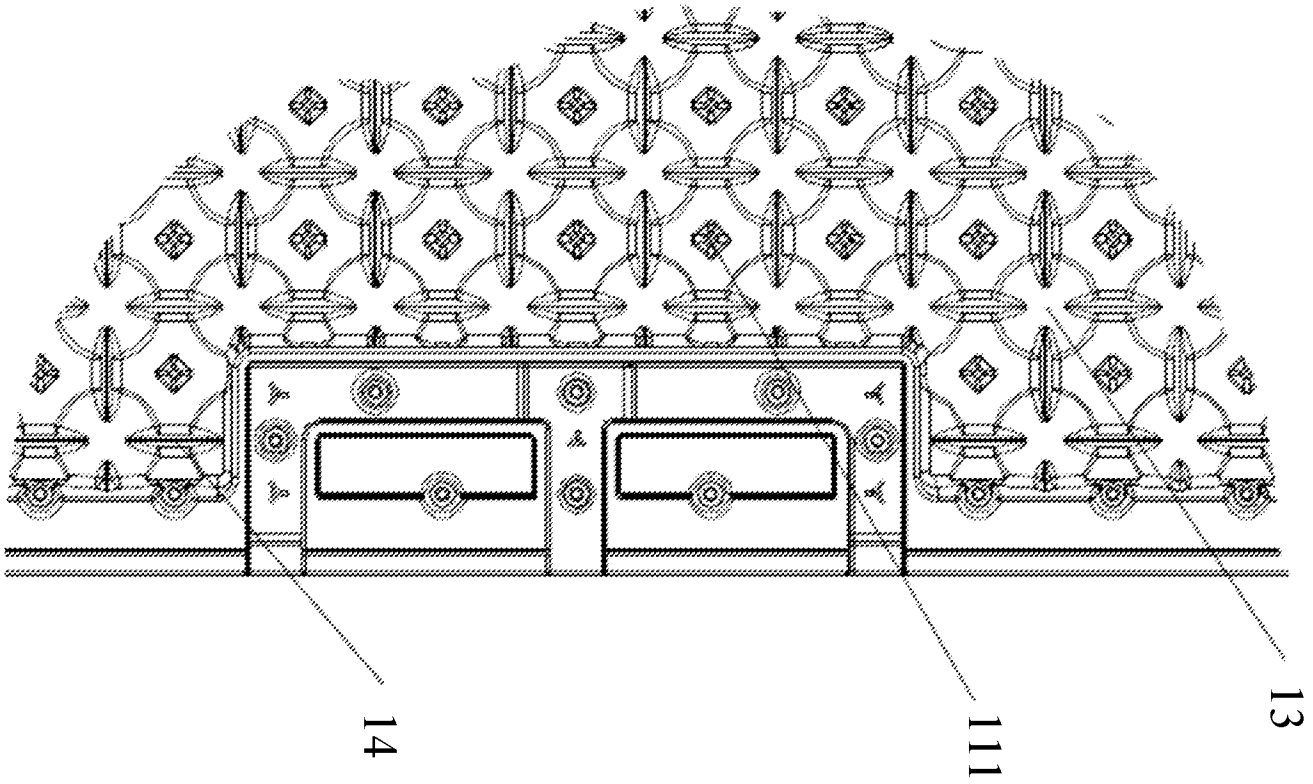
FIG. 5B is an enlarged view schematically illustrating a portion of FIG. 5A.
Figure 6:
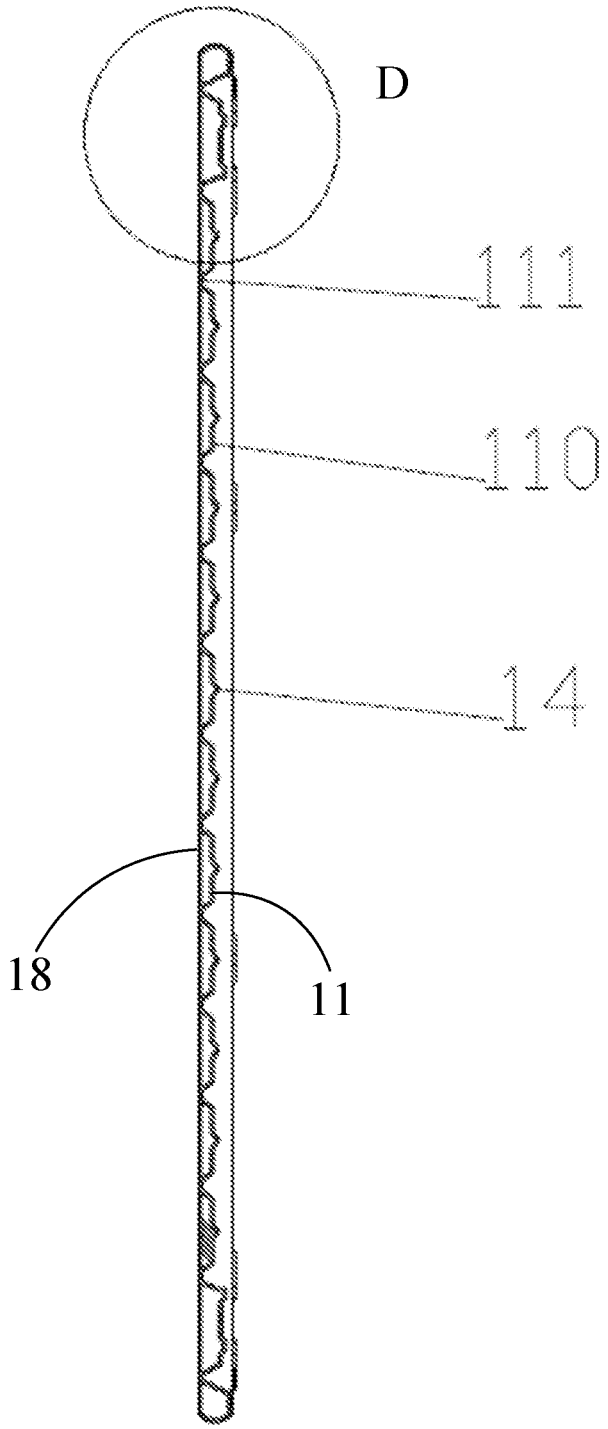
FIG. 6 is a cross-sectional view taken along line B-B of FIG. 5A.
Figure 7:
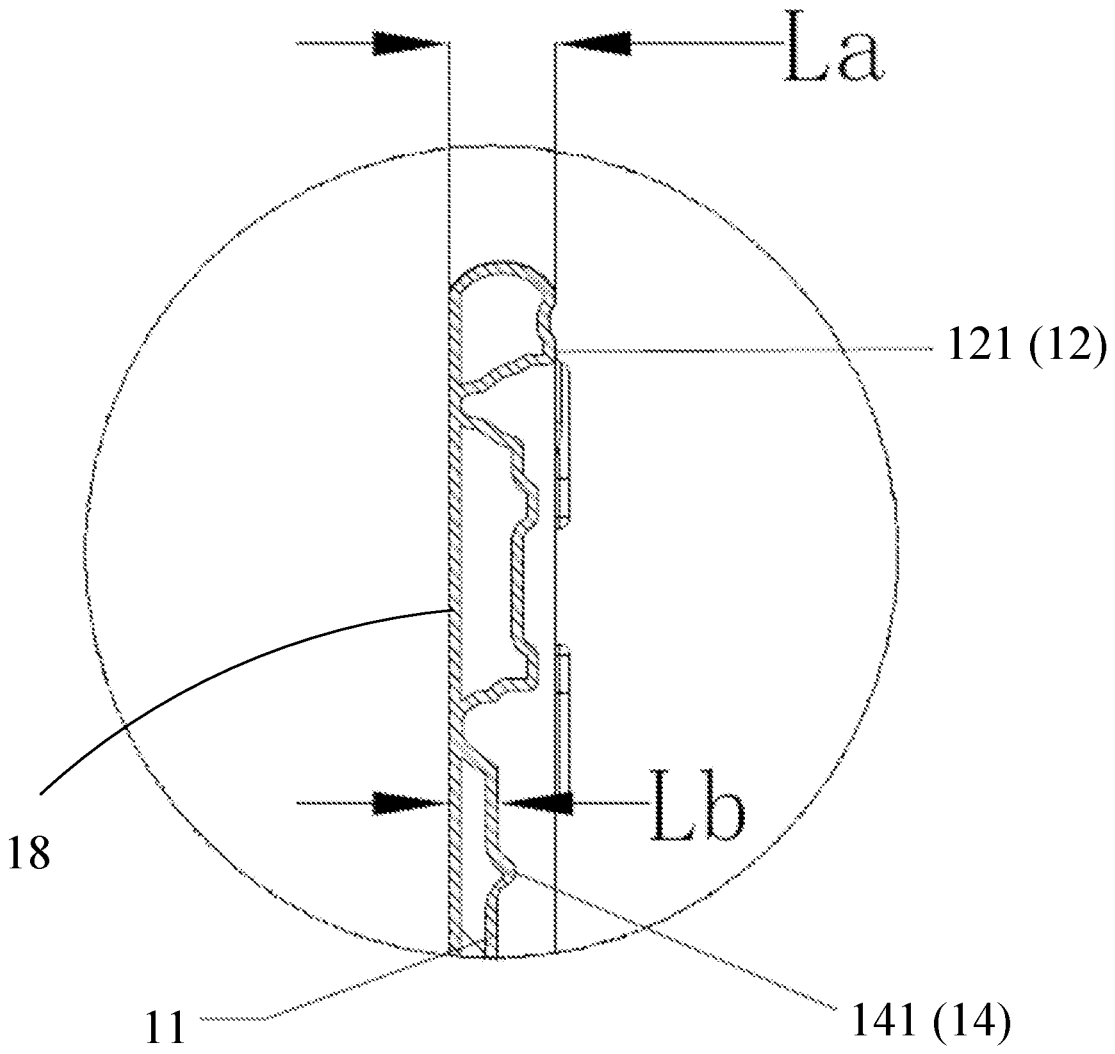
FIG. 7 is an enlarged view taken along circle D of FIG. 6.
Figure 8:
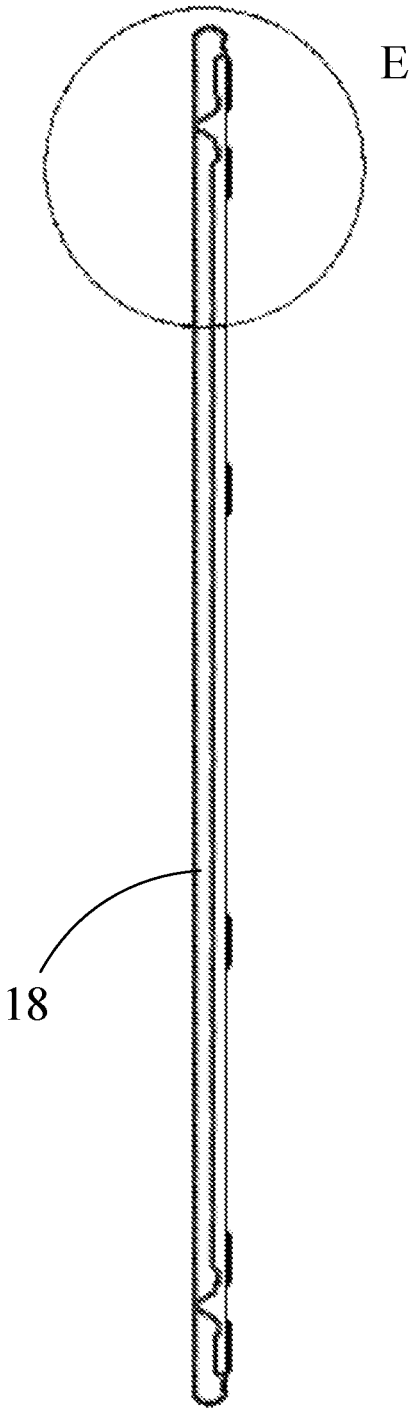
FIG. 8 is a cross-sectional view taken along line C-C of FIG. 5A.
Figure 9:
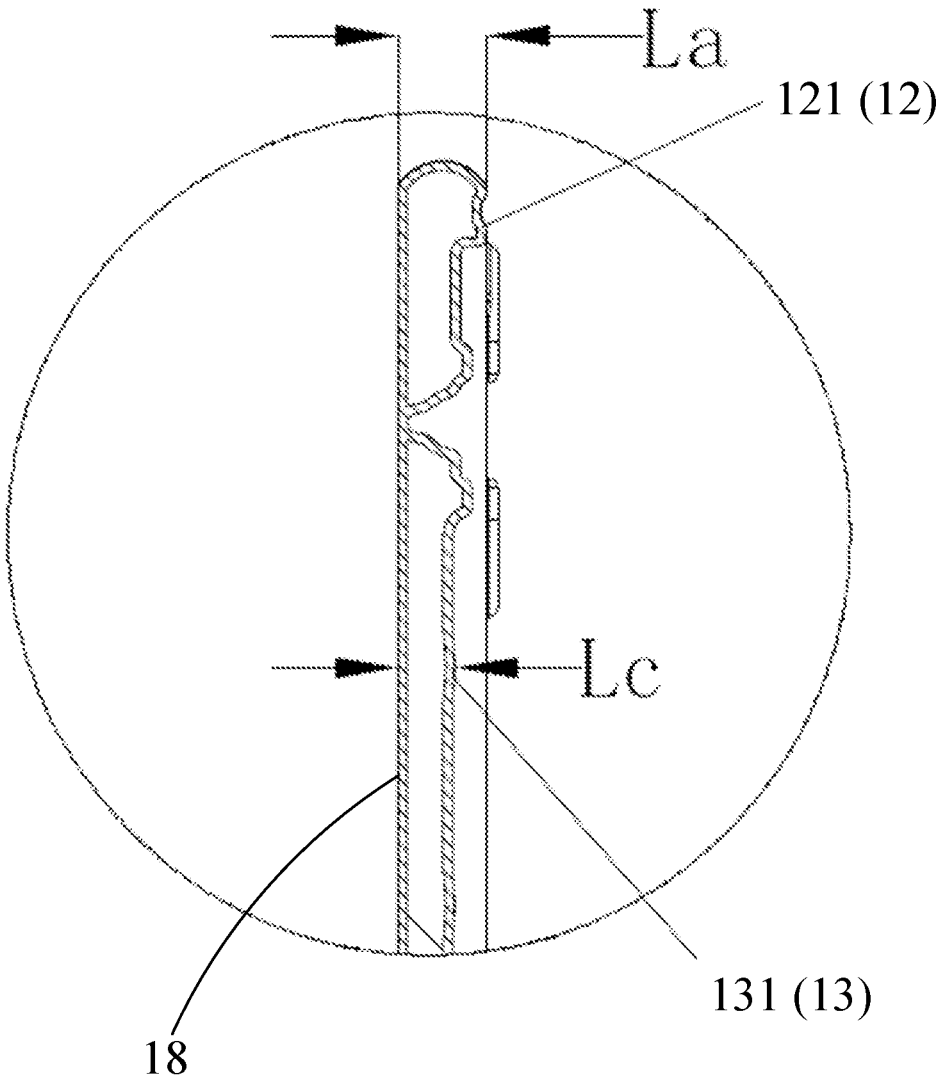
FIG. 9 is an enlarged view taken along circle E of FIG. 8.

In some exemplary embodiments, panel 10 includes a plurality of protrusions 13 monolithically formed with the panel across at least a portion of the respective panel to enhance a strength of the panel. The protrusions can be but do not have to be identical or substantially the same as each other. For instance, the protrusions can have the same or different shapes or sizes, or can be arranged in the same or different orientations. By way of example, FIGS. 4 and 5A illustrate substantially the same protrusions.

In some exemplary embodiments, protrusion 13 protrudes downward from lower panel surface 11 and include a lower protrusion surface, such as lower protrusion surface 131. The lower protrusion surface is spaced apart from the upper panel surface at a third distance, e.g., "Lc". In some exemplary embodiments, third distance "Lc" is equal to or less than 1.5×, 1.4×, 1.3× or 1.2× first distance "Lb".

The lower protrusion surface of protrusion 13 can be planar or non-planar. For instance, in an exemplary embodiment, the lower protrusion surface is substantially flat. In another exemplary embodiment, the lower protrusion surface is arched or dome-shaped. In still another exemplary embodiment, the lower protrusion surface of at least one protrusion in the plurality of protrusions is planar while the lower protrusion surface of at least one other protrusion in the plurality of protrusions is non-planar.

The plurality of protrusions can be distributed uniformly, generally uniformly, or non-uniformly across at least a portion of the lower panel surface of the panel, in which adjacent depressions are generally spaced apart from each other. In some exemplary embodiments, at least some of the protrusions are arranged in a pattern, which can be regular or irregular. For instance, some or all of the protrusions are arranged to form row(s), column(s), circle(s) or the like. In some exemplary embodiments, the plurality of protrusions is formed across at least a majority portion (e.g., at least 60%, at least 70%, at least 80% or at least 90% or substantially the entirety) of the panel. In some exemplary embodiments, protrusions in at least a subset of the plurality of protrusions are arranged substantially uniformly across the portion of the panel.

In some exemplary embodiments, panel 10 includes a plurality of ribs, such as rib 14, monolithically formed with the panel. Rib 14 can have any suitable shape and size and can be oriented in any suitable orientation. Different ribs can be but do not have to be identical or substantially the same as each other. For instance, different ribs can have the same or different shapes or sizes, or can be arranged in the same or different orientations. By way of example, the plurality of ribs 14 is illustrated to be monolithically formed with the lower panel surface and/or protrusions 13, each protruding downward from the lower panel surface of the panel. In an exemplary embodiment, a rib is a crease, a ridge or the like formed at the second panel wall and/or protrusion. In some exemplary embodiments, a rib in at least a subset of the plurality of ribs extends from one protrusion to another protrusion, and thus connects corresponding adjacent protrusions in the plurality of protrusions. Rib 14 includes a lower rib surface or rim, such as lower rib surface or rim 141. In a non-limiting exemplary embodiment, the lower rib surface or rim is spaced apart from the upper panel surface at a distance that is substantially the same as third distance "Lc", e.g., the height of the rib is substantially the same as the height of the corresponding protrusion.

In some exemplary embodiments, panel 10 includes a plurality of depressions, such as depressions 111, each recessing from the lower panel surface toward the upper panel surface. Like the protrusions, different depressions can be but do not have to be identical or substantially the same as each other. For instance, different depressions can have the same or different shapes or sizes, or can be arranged in the same or different orientations. Also like the protrusions, depressions 111 can be distributed uniformly, generally uniformly, or non-uniformly across at least a portion of the panel. In addition, depressions 111 can be formed at any suitable positions independent from other strengthening elements (e.g., protrusions 13) or related to other strengthening elements (e.g., protrusions 13). The number of the depressions can the same as or different from the number of protrusions. For instance, in some exemplary embodiments, at least some protrusions (e.g., protrusions in at least a subset of the plurality of protrusions) are arranged alternately with some depressions (e.g., depressions in at least a subset of the plurality of depressions) across at least a portion of the panel. In an exemplary embodiment, all protrusions are arranged alternately with the depressions. By way of example, FIGS. 4 and 5A illustrate the depressions and protrusions distributed substantially uniformly and alternating with each other across the majority of the panel.

Figure 3:
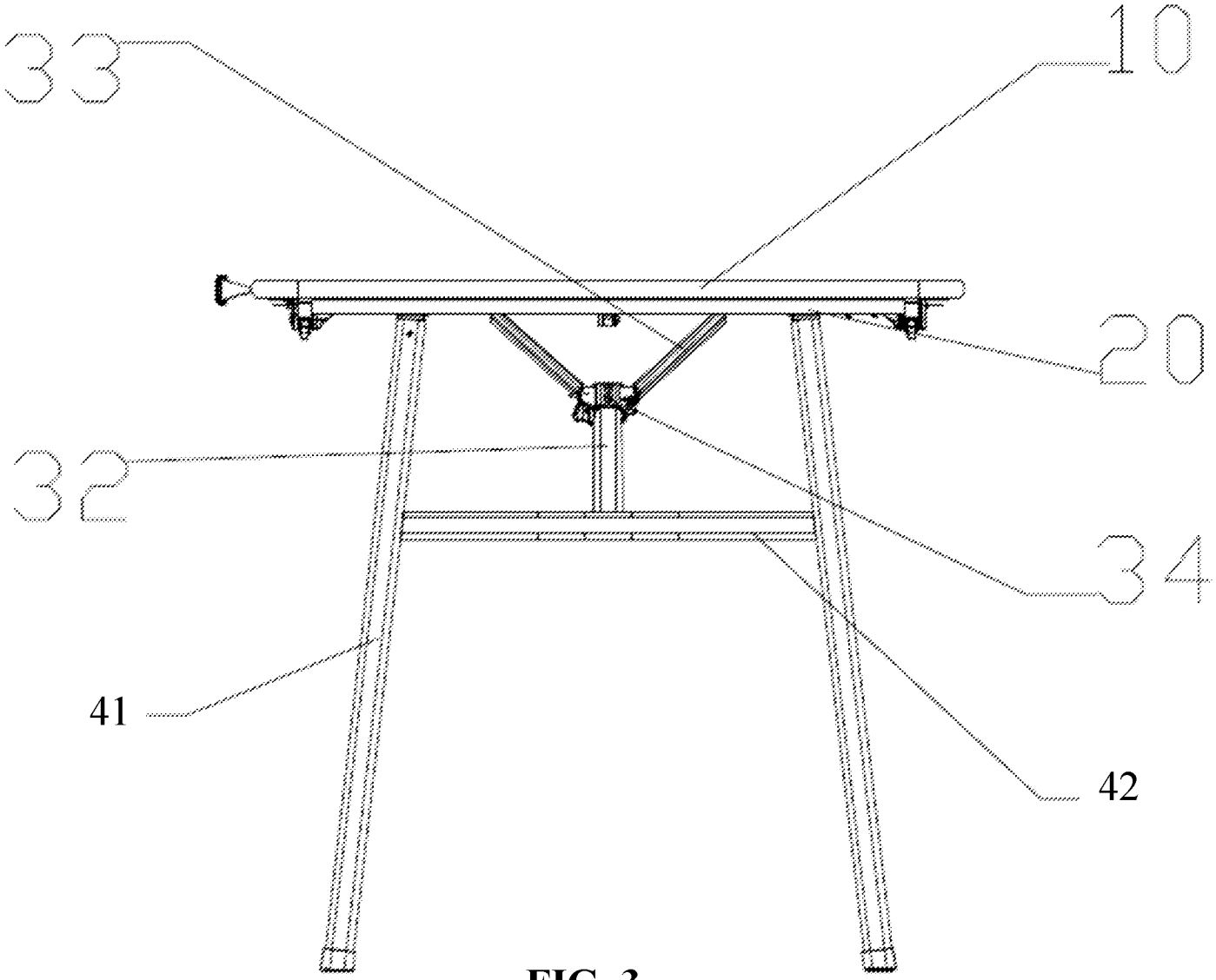
FIG. 3 is a side view schematically illustrating the foldable table of FIG. 1.
Figure 10:
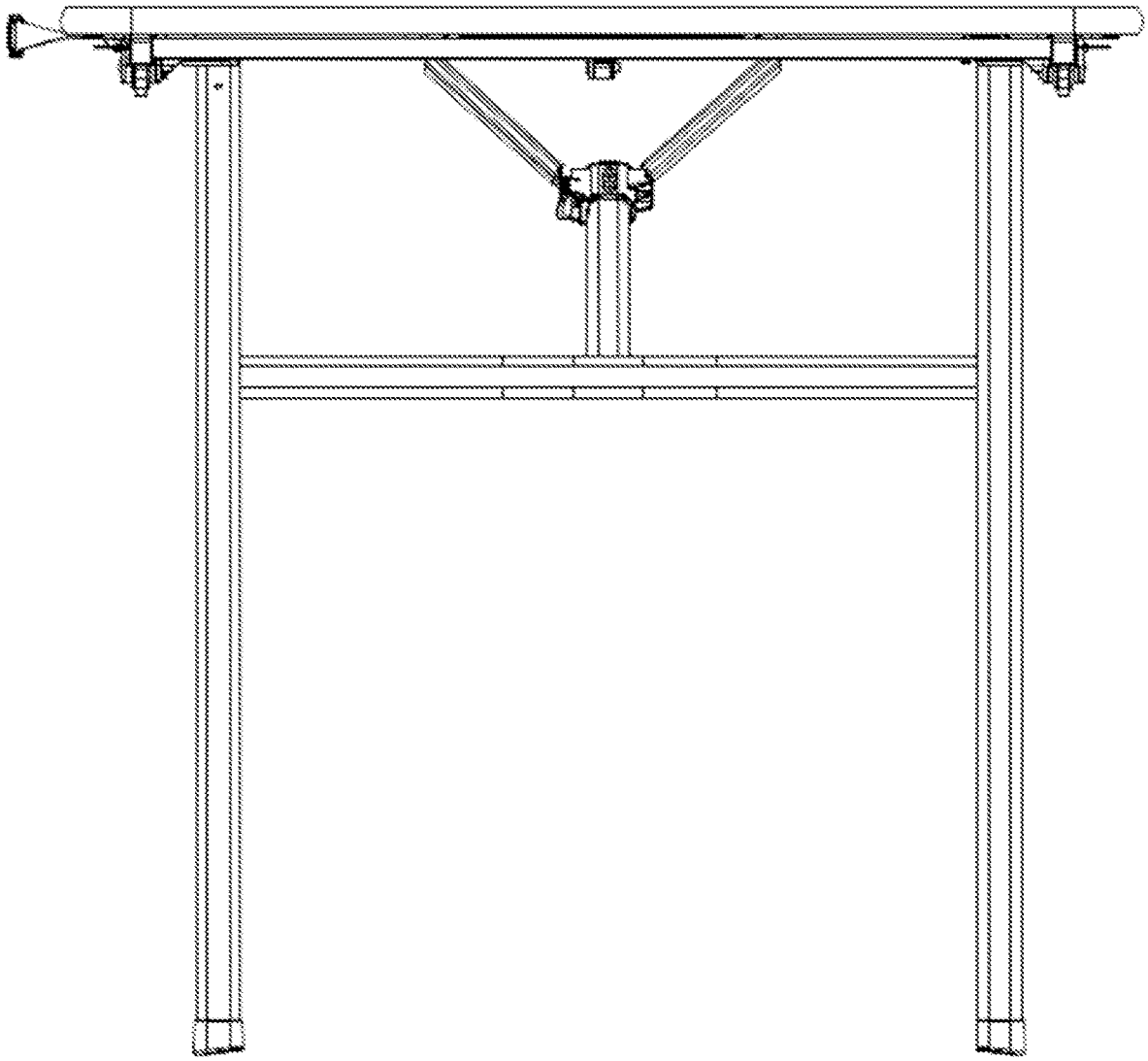
FIG. 10 is a side view schematically illustrating an alternative foldable table in an unfolded state in accordance with exemplary embodiments of the present disclosure.
Figure 11:
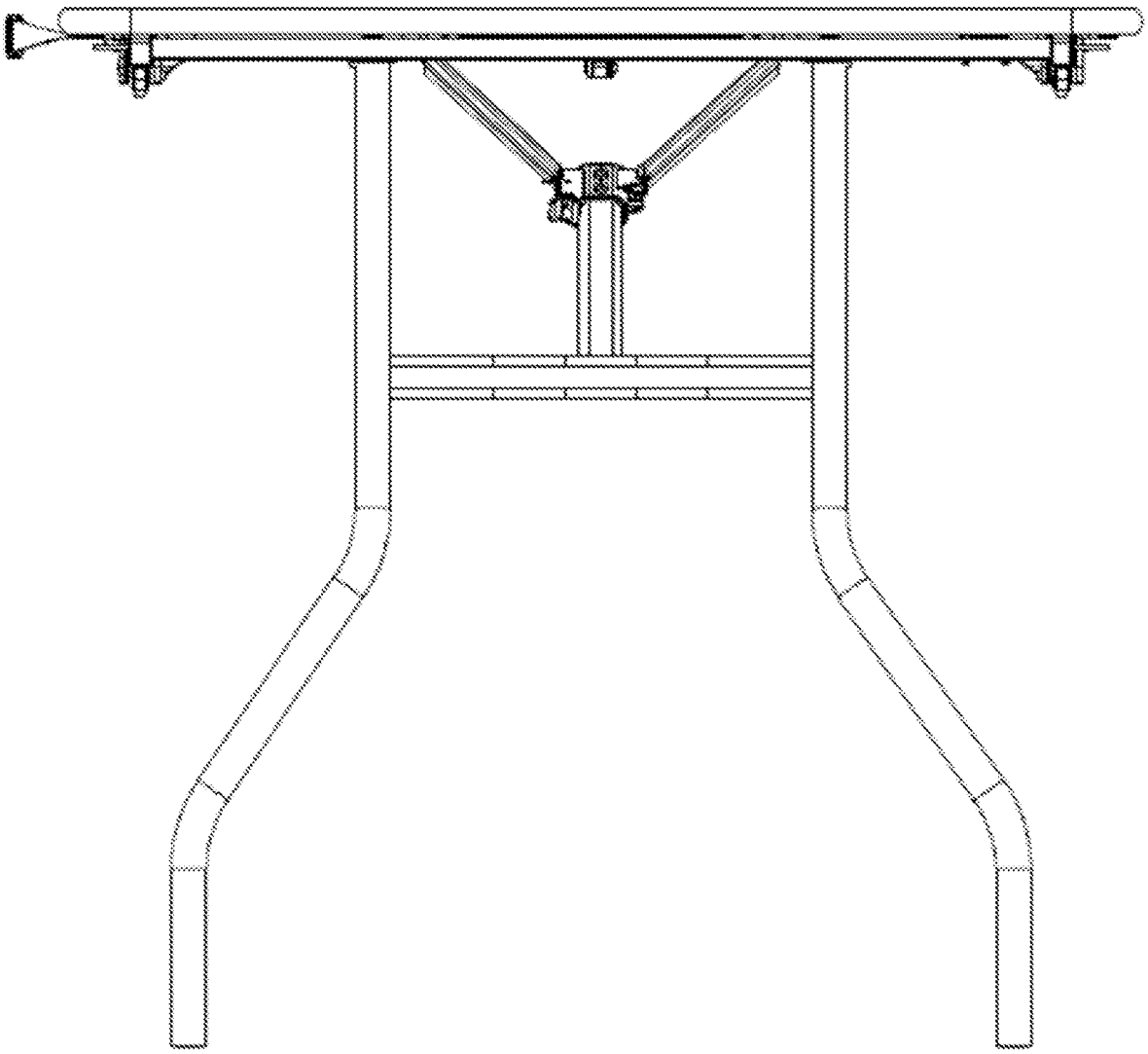
FIG. 11 is a side view schematically illustrating another alternative foldable table in an unfolded state in accordance with exemplary embodiments of the present disclosure.
Figure 12:
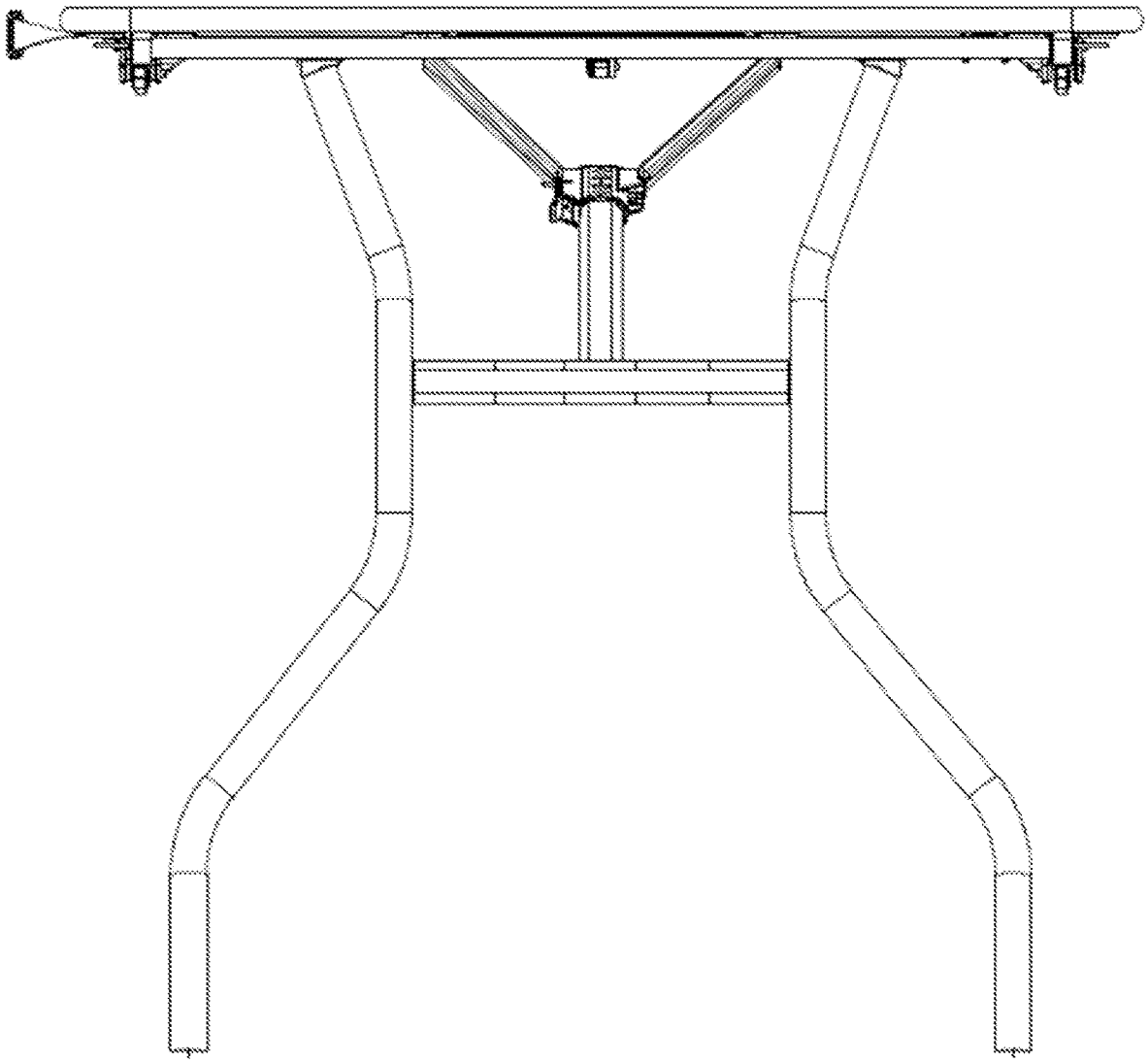
FIG. 12 is a side view schematically illustrating still another alternative foldable table in an unfolded state in accordance with exemplary embodiments of the present disclosure.

In some exemplary embodiments, table 1 includes additional, optional or alternative features. For instance, as a non-limiting example, in some embodiments, table 1 includes a handle, such as handle 22, to facilitate easy carrying as illustrated in FIG. 2. The handle can be coupled with panel 10 and/or mounting assembly 20. As another non-limiting example, legs 41 of table 1 can have various shapes. For instance, they can be straight and oblique as illustrated in FIG. 3, or straight and vertical as illustrated in FIG. 10. They can also be bended or curved. For instance, they can have straight upper portions and outwardly extended lower portions as illustrated in FIG. 11 to improve the stability of the table when in use. They can also have inwardly bended or curved (e.g., toward each other) middle portions and outwardly extended upper/lower portions as illustrated in FIG. 12 to improve the stability of the table when in use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first member could be termed a second member, and, similarly, a second member could be termed a first member, without changing the meaning of the description, so long as all occurrences of the "first member" are renamed consistently and all occurrences of the "second member" are renamed consistently.

What is claimed is:

1. A foldable table comprising:

a first panel and a second panel, each respective panel in the first and second panels comprising:

an upper panel surface;

a lower panel surface spaced apart from the upper panel surface at a first distance; and a plurality of protrusions, a plurality of depressions, and a plurality of ribs monolithically formed with the respective panel across at least a portion of the respective panel, each of the plurality of protrusions protruding downward from the lower panel surface and comprising a lower protrusion surface below the lower panel surface and spaced apart from the upper panel surface at a third distance, wherein the third distance is equal to or less than 1.5 times the first distance, wherein each of the plurality of depressions recesses from the lower panel surface toward the upper panel surface, and wherein each respective protrusion in at least a subset of the plurality of protrusions is adjacent to at least two corresponding protrusions in the plurality of protrusions, adjacent to at least two corresponding depressions in the plurality of depressions, and connected to the adjacent corresponding protrusions by at least two ribs in the plurality of ribs;

a first mounting assembly and a second mounting assembly pivotally coupled with each other at proximal sides of the first and second mounting assemblies, wherein the first mounting assembly is disposed below the lower panel surface of the first panel and coupled with the first panel, and the second mounting assembly is disposed below the lower panel surface of the second panel and coupled with the second panel; and a first leg assembly and a second leg assembly, wherein the first leg assembly is pivotally coupled with the first mounting assembly at a distal side of the first mounting assembly, and the second leg assembly is pivotally coupled with the second mounting assembly at a distal side of the second mounting assembly.

2. The foldable table of claim 1, wherein each respective panel further comprises:

a ridge monolithically formed with the respective panel at or adjacent to an edge of the respective panel, the ridge extending downward beyond the lower panel surface and comprising a lower ridge surface spaced apart from the upper panel surface at a second distance, wherein the second distance is equal to or less than two times the first distance.

3. The foldable table of claim 1, wherein the lower panel surface is substantially parallel to the upper panel surface.

4. The foldable table of claim 1, further comprising:

a first supporting assembly coupled with the first leg assembly and first mounting assembly and configured to control rotation of the first leg assembly with respect to the first mounting assembly; and a second supporting assembly coupled with the second leg assembly and second mounting assembly and configured to control rotation of the second leg assembly with respect to the second mounting assembly.

5. The foldable table of claim 1, wherein the lower protrusion surface of a protrusion in the plurality of protrusions is substantially flat, arched, or dome-shaped.

6. The foldable table of claim 1, wherein the plurality of protrusions is formed across at least a majority portion of the respective panel.

7. The foldable table of claim 1, wherein protrusions in the of the plurality of protrusions are arranged substantially uniformly across the portion of the respective panel.

8. The foldable table of claim 1, wherein depressions in the of the plurality of depressions are arranged alternately with protrusions in the of the plurality of protrusions across the portion of the respective panel, and wherein the plurality of depressions and the plurality of protrusions collectively enhance the strength of the respective panel.

9. The foldable table of claim 1, wherein each of the plurality of ribs protrudes downward from the lower panel surface of the respective panel.

10. The foldable table of claim 9, wherein each of the plurality of ribs comprises a lower rib surface or rim spaced apart from the upper panel surface at a fourth distance that is substantially the same as the third distance.

11. The foldable table of claim 9, wherein each of the plurality of ribs comprises a lower rib surface or rim spaced apart from the upper panel surface at a fourth distance that is substantially the same as the third distance.

12. The foldable table of claim 1, wherein each respective protrusion in at least the subset of the plurality of protrusions is adjacent to at least three corresponding protrusions in the plurality of protrusions, adjacent to at least three corresponding depressions in the plurality of depressions, and connected to the adjacent corresponding protrusions by at least three ribs in the plurality of ribs.

* * * * *